US011253426B2

(12) United States Patent
Peron

(10) Patent No.: US 11,253,426 B2
(45) Date of Patent: Feb. 22, 2022

(54) APPARATUS FOR CARRYING OUT TREATMENTS ON THE HUMAN BODY

(71) Applicant: Giuseppe Peron, Creazzo (IT)

(72) Inventor: Giuseppe Peron, Creazzo (IT)

(73) Assignee: TIRS S.R.L., Vicenza (IT)

( * ) Notice: Subject to any disclaimer, the term of this patent is extended or adjusted under 35 U.S.C. 154(b) by 390 days.

(21) Appl. No.: 16/314,419

(22) PCT Filed: Jun. 29, 2017

(86) PCT No.: PCT/IB2017/053898

§ 371 (c)(1),
(2) Date: Dec. 30, 2018

(87) PCT Pub. No.: WO2018/002860

PCT Pub. Date: Jan. 4, 2018

(65) Prior Publication Data

US 2019/0167517 A1 Jun. 6, 2019

(30) Foreign Application Priority Data

Jul. 1, 2016 (IT) ..... 102016000068859

(51) Int. Cl.

| | |
|---|---|
| ***A61H 23/04*** | (2006.01) |
| ***A61H 9/00*** | (2006.01) |
| ***A61H 7/00*** | (2006.01) |

(52) U.S. Cl.

CPC ..... *A61H 23/04* (2013.01); *A61H 7/001* (2013.01); *A61H 9/00* (2013.01); *A61H 9/005* (2013.01);

(Continued)

(58) Field of Classification Search

CPC ..... A61H 23/04; A61H 9/00; A61H 9/005; A61H 7/001; A61H 7/005; A61H 2009/0042; A61H 2201/0207; A61H 2201/0214; A61H 2201/0228; A61H 2201/0242; A61H 2201/025;

(Continued)

(56) References Cited

U.S. PATENT DOCUMENTS

| | | | | |
|---|---|---|---|---|
| 5,109,558 | A | 5/1992 | Di Blasi | |
| 6,551,450 | B1 * | 4/2003 | Thomas | A61H 9/0078 156/580.1 |

(Continued)

FOREIGN PATENT DOCUMENTS

| | | |
|---|---|---|
| EP | 1834621 | 9/2007 |
| EP | 2039337 | 3/2009 |

(Continued)

*Primary Examiner* — Quang D Thanh

(74) *Attorney, Agent, or Firm* — Mark M. Friedman

(57) ABSTRACT

Apparatus for carrying out treatments on the human body, which includes a central unit provided with a compressor and two operational heads, each provided with a plate intended to contact the skin of the patient to be treated, and susceptible of being temperature-conditioned with a corresponding hot or cold fluid. Moreover, each operational head is provided with a plurality of pneumatic actuators, which are operable to move, in a retracted position and in a protruding position, by corresponding solenoid valves which are housed in the operational head, and are connected to the compressor (9) and to the corresponding pneumatic actuators.

9 Claims, 6 Drawing Sheets

(52) U.S. Cl.
CPC ..... *A61H 7/005* (2013.01); *A61H 2009/0042* (2013.01); *A61H 2201/025* (2013.01); *A61H 2201/0207* (2013.01); *A61H 2201/0214* (2013.01); *A61H 2201/0228* (2013.01); *A61H 2201/0242* (2013.01); *A61H 2201/0264* (2013.01); *A61H 2201/105* (2013.01); *A61H 2201/1238* (2013.01); *A61H 2201/1246* (2013.01); *A61H 2201/1664* (2013.01); *A61H 2201/1685* (2013.01)

(58) Field of Classification Search
CPC ..... A61H 2201/0264; A61H 2201/105; A61H 2201/1238; A61H 2201/1685
See application file for complete search history.

(56) References Cited

U.S. PATENT DOCUMENTS

| | | | | |
|---|---|---|---|---|
| 8,357,108 | B2 | 1/2013 | Taylor | |
| 2007/0167888 | A1* | 7/2007 | Taylor | A61H 7/001 601/103 |
| 2012/0060294 | A1* | 3/2012 | Dzioba | A47C 27/081 5/655.3 |
| 2012/0079662 | A1* | 4/2012 | Dzioba | A61G 7/05776 5/713 |

FOREIGN PATENT DOCUMENTS

| | | | | |
|---|---|---|---|---|
| EP | 2386282 | A * | 11/2011 | A61H 9/00 |
| WO | 03022197 | | 3/2003 | |
| WO | 2011153350 | | 12/2011 | |
| WO | 2012048042 | | 4/2012 | |

* cited by examiner

APPARATUS FOR CARRYING OUT TREATMENTS ON THE HUMAN BODY

FIELD OF APPLICATION

The present invention regards an apparatus for carrying out treatments on the human body, in particular for aesthetic or therapeutic use, according to the preamble of the main independent claim.

The present apparatus is intended to be advantageously employed for the localized non-invasive treatment of the human body.

In fact, for such purpose this comprises an operational head (also termed handpiece) adapted to be grasped by an operator and moved in contact with the skin of the patient at the zones to be treated.

Due to a synergistic massaging and thermal action, the apparatus according to the invention is employable with the aim of conferring wellbeing as well as for aesthetic reasons, e.g. for treating specific problems of the epidermis and/or of the dermis, as a non-limiting example in order to facilitate muscle toning, wrinkle relaxing or dissolution of adipose accumulations or cellulite. The apparatus is also adapted for use with therapeutic aims, such as in order to facilitate blood and lymphatic circulation.

The apparatus according to the invention is therefore situated in the field of technical aids intended for aesthetic and/or therapeutic treatment and/or even only for the health of the human body and is mainly intended for a use in health spas/centers.

STATE OF THE ART

From European patent EP 1834621A, on behalf of the same applicant, an apparatus is known for executing aesthetic or therapeutic treatments on the human body, which comprises a central unit and at least two operational heads that can be gripped by an operator and connected to the central unit in order to receive signals and fluids from the latter that allow the operation thereof, as specified hereinbelow.

Each operational head is provided with a work plate having a treatment surface intended to come into contact with the skin of the patient, which is subjected to the thermal exchange action of a carrier fluid, which is cooled or heated by the central unit connected to the plate by means of a circulation duct of the carrier fluid.

Advantageously, the apparatus described in this patent provides for associating two separate operational heads with the skin heating or cooling functions, by separating the heating and the cooling of the work plate into two separate heat exchange circuits.

In accordance with such apparatus, therefore, each operational head is conferred a specific skin heating or cooling function.

Such provision has considerable structural advantages with respect to the preceding apparatuses of known type which provided for complex solutions for varying the functionality of a same operational head, by supplying it with separate heating and cooling carrier fluids.

The apparatus of known type briefly described above has nevertheless in practice demonstrated that it does not lack drawbacks, in particular connected to the expected massaging action of the operational heads thereof.

More in detail, in fact, each operational head is also provided with a plurality of linear actuators that can be driven by the central unit by means of pneumatic driving means in order to reciprocally move a small piston with back and forth movement protruding from the treatment surface of the plate, so as to confer a succession of small blows to the skin that produce an enjoyable massaging effect.

More in detail, the pneumatic driving means comprise a compressor which is connected to the actuators with ducts for driving an air circuit in order to supply them with an approximate operating pressure on the order of several bar and more precisely between 2 and 8 bar.

In accordance with such known apparatus, the pneumatic driving means control the opening and the closing of the pressurized compressed air towards the drive ducts at the central unit or in proximity to the compressor.

The main drawback of such apparatus lies in the fact that given the distance between the central unit and the operational heads, the driving conduits which transport the air are particularly long, such that the times for emptying the drive ducts in order to allow the return of the pistons before a new pulse are particularly high, with consequent effects that are unsuitable for the development of an effective work method.

On the other hand, the selection of employing compressors with considerable flow rate, for driving the movements of the pistons of the actuators in a quicker and more effective manner, cannot be easily done since this would involve sizes and noises incompatible with the normal use of the apparatus, in particular in a health spa/center (e.g. employing industrial compressors).

Known from the patent application WO 2011/153350 is an apparatus for carrying out treatments on the human body, which comprises a central unit containing a compressor and several operational heads provided with a plurality of pneumatic pistons connected to the compressor and projecting from a plate.

This apparatus has the drawback that the solenoid valves are not housed in the operational head but rather in the central unit, with all of the abovementioned disadvantages that this entails.

In addition, the pistons are not intended to come into contact with the skin of the patient to be treated, since a cover is provided on the operational head. Moreover, the pistons of the apparatus described in WO 2011/153350 are not arranged in a retracted position in which their corresponding free end is contained in holes made in the plate, but rather the free end of the pistons always projects from the treatment surface of the plate even when the pistons are situated in their retracted position.

PRESENTATION OF THE INVENTION

In this situation, the main problem underlying the present invention is therefore to overcome the abovementioned prior art drawbacks, by providing an apparatus for carrying out treatments on the human body which achieves an optimal massaging action on the skin.

Another object of the present invention is to provide an apparatus for carrying out treatments on the human body, which allows precisely controlling the massaging action produced by a plurality of pistons.

Another object of the present invention is to provide an apparatus for carrying out treatments on the human body which produces little noise and is not bulky.

Another object of the present invention is to provide an apparatus for carrying out treatments on the human body which allows carrying out maintenance operations in an extremely facilitated manner.

Another object of the present invention is to provide an apparatus for carrying out treatments on the human body which is provided with at least one operational head that is particularly compact, with limited size and which can be easily handled by an operator.

Another object of the present invention is to provide an apparatus for carrying out treatments on the human body which is structurally simple, inexpensive and safe and reliable in operation.

BRIEF DESCRIPTION OF THE DRAWINGS

The technical characteristics of the invention, according to the aforesaid objects, can be clearly found in the below-reported claims and the advantages thereof are more evident in the following detailed description, made with reference to the enclosed drawings, which represent a merely exemplifying and non-limiting embodiment of the invention, in which:

DETAILED DESCRIPTION

Figure 1:
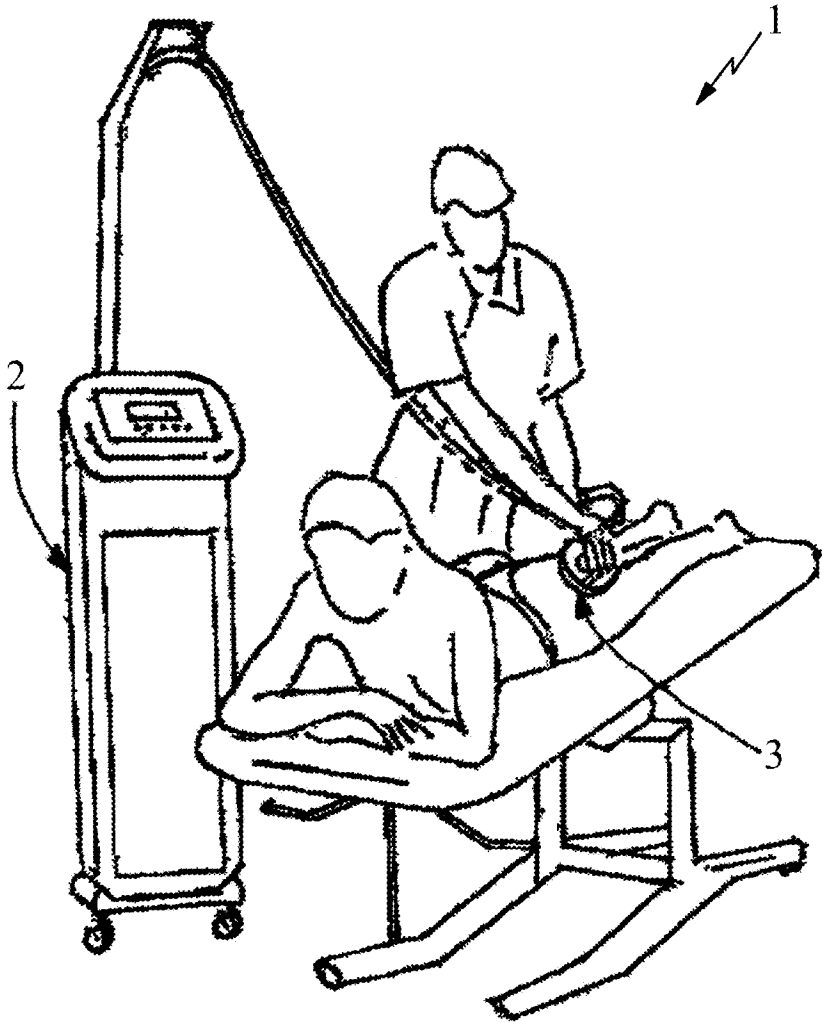
FIG. 1 shows a general view of the apparatus for carrying out treatments on the human body, object of the present invention.

With reference to the enclosed drawings, reference number 1 overall indicates an apparatus for carrying out treatments on the human body in particular for aesthetic, therapeutic or health use, object of the present invention.

In accordance with the enclosed figures, the apparatus comprises a central unit 2 and at least two operational heads 3, shaped with anatomic form for an easy grip by an operator.

Advantageously, two larger operational heads can be provided for massaging wide areas of the body such as the back, and two smaller operational heads can be provided for limited-size areas of the body, such as the face.

The central unit 2 is formed by a box-like support structure, advantageously movable on wheels, which is associated with a logic control unit (schematically indicated with 60) which houses various operating means for the operation of the apparatus 1, in particular including cooling means, heating means and pneumatic driving means which will be described hereinbelow.

Each operational head 3 is connected to the central unit 2 in order to receive control and fluid signals from the latter which allow the operation thereof, as specified hereinbelow.

Each operational head 3 is provided with a work plate 4 having a treatment surface 4A intended to come into contact with the skin to be treated of the patient, and with an internal face 4B susceptible of delimiting, together with a cover 40, a closed chamber 41 in which the thermal exchange with a carrier fluid occurs, aimed to heat or cool the plate 4.

The latter is heating or cooling conditioned by means of suitable heating means 5 and cooling means 6 housed in the central unit 2. Advantageously, on the internal face 4B of the plate 4, a heat exchange coil (not shown) is arranged for transferring the heat from the carrier fluid to the plate 4 or vice versa.

The chamber 41 of the plate 4 is connected to the central unit 2 by means of a deliver duct 7A and a return duct 7B for the circulation of the carrier fluid indicated with the dotted line in FIG. 2.

Preferably, the apparatus 1 provides for associating the skin heating and cooling functions with two separate operational heads 3, by separating the heating and the cooling of the work plate 4 of the relative operational head 3 into two separate heat exchange circuits.

In accordance with such preferred selection of the apparatus 1, therefore, each operational head 3 is conferred only one specific skin heating or cooling function, since the other function is assigned to the other operational head 3; the same operational head cannot complete both heating and cooling functions, since it is only supplied with a hot fluid or with a cold fluid.

The characteristics of the heating means 5 and of the cooling means 6 as well as the shape of the chamber 41 are described in detail in accordance with a possible embodiment in the patent EP 2386282B1 of the same applicant in paragraphs [0010]-[0012] which are intended as incorporated herein for reference purposes.

Each operational head 3 is also provided with a plurality of linear actuators 8 (e.g. three of these, aligned in accordance with the drawings of the enclosed figures) controlled by the logic control unit 60 provided in the central unit 2, by means of pneumatic driving means.

The latter comprise a compressor 9, which is connected to the actuators 8 in order to supply them with an air pressure which in operating conditions is approximately on the order of several bar and more precisely between 2 and 8 bar.

More in detail, each linear actuator 8 comprises a piston 10, slidably movable inside a jacket 11, which is provided with a connection 12 connected to the compressor 9 for its supply with pressurized air.

The piston 10 is mounted on the plate 4 at a hole thereof, so as to be able to project, with a free end 10A thereof, from the treatment surface 4A and then be able to act on the skin of the patient.

The piston 10 is connected to a return spring 14 in turn acting on the jacket 11 susceptible of forcing the piston towards a retracted position.

In operation, the logic control unit 60 drives the pneumatic driving means so that the compressor 9 sends a flow of pressurized air to the linear actuators 8. Consequently, the piston 10 is moved from a retracted position, in which the free end 40 is contained inside the hole of the plate 4, to a protruding position, in which the piston 10 overcomes the force of the spring 14 by moving towards the outlet of the hole of the plate in a manner such that its free end 40 is extended beyond the treatment surface 4A in order to massage the skin of the patient.

At this point, the logic control unit drives—as detailed hereinbelow—the discharge of the air pressure in the linear actuator 8 such that the piston 10 can return from the protruding position to the retracted position.

In operation, the piston 10 is driven to be moved as indicated above in a reciprocating manner, with back and forth movement that confers a massaging effect to the skin.

The pistons 10 can be moved in unison or preferably in a reciprocating manner with respect to each other, and they can be actuated with higher or lower frequency or with higher or lower force by the control unit 60.

According to the idea underlying present invention, the pneumatic driving means also comprise a plurality of solenoid valves 15, each of which associated with a corresponding pneumatic actuator 8, and housed in the operational head 3.

More in detail, according to the invention each solenoid valve 15 is connected to the compressor 9 by means of a delivery conduit 16, connected to the pneumatic actuator 8 by means of a connecting conduit 17, and provided with a discharge opening 18.

Each valve 15 is thus advantageously a three-way valve with the discharge opening 18 and with a first and a second opening 19 and 20 respectively connected to the delivery conduit 16 and to the connecting conduit 17.

The solenoid valve 15 is thus susceptible of discharging, through the discharge opening 18, the pressurized air contained in the pneumatic actuator 8 and in the connecting conduit 17 to bring back the piston 10 to the retracted position, or into the position in which it is not supplied with compressed air.

Due to the inventive selection of arranging the solenoid valves for driving the pistons in the same operational head 3, the discharge of the air through the discharge opening 18 of the solenoid valve 15 occurs very quickly, so as to allow sequences of massaging pulses produced by the pistons 10 on the skin of the patient that are very close to each other. In addition, due to such provision, such compressor 9 must provide—between one actuation and the next—only the air flow rate necessary for bringing the chamber of the pneumatic actuator 8 and the connecting conduit 17 to the desired pressure (e.g. 2-8 bar), such that the compressor 9 can be sized with relatively limited powers.

The logic control unit 60 is thus susceptible in operation of driving each solenoid valve 15 through electrical connections 61, between an active position, in which it closes the discharge opening 18 and simultaneously opens the connection between the compressor 9 and the pneumatic actuator 8, allowing the passage of air through the aforesaid delivery and connecting conduits 16, 17; and a passive position, in which it closes the supply to the connecting conduit 17 and connects the latter to the discharge opening 18 in order to allow the evacuation of pressurized air from the actuator 8 and from the connecting conduit 17 itself.

Figure 2A:
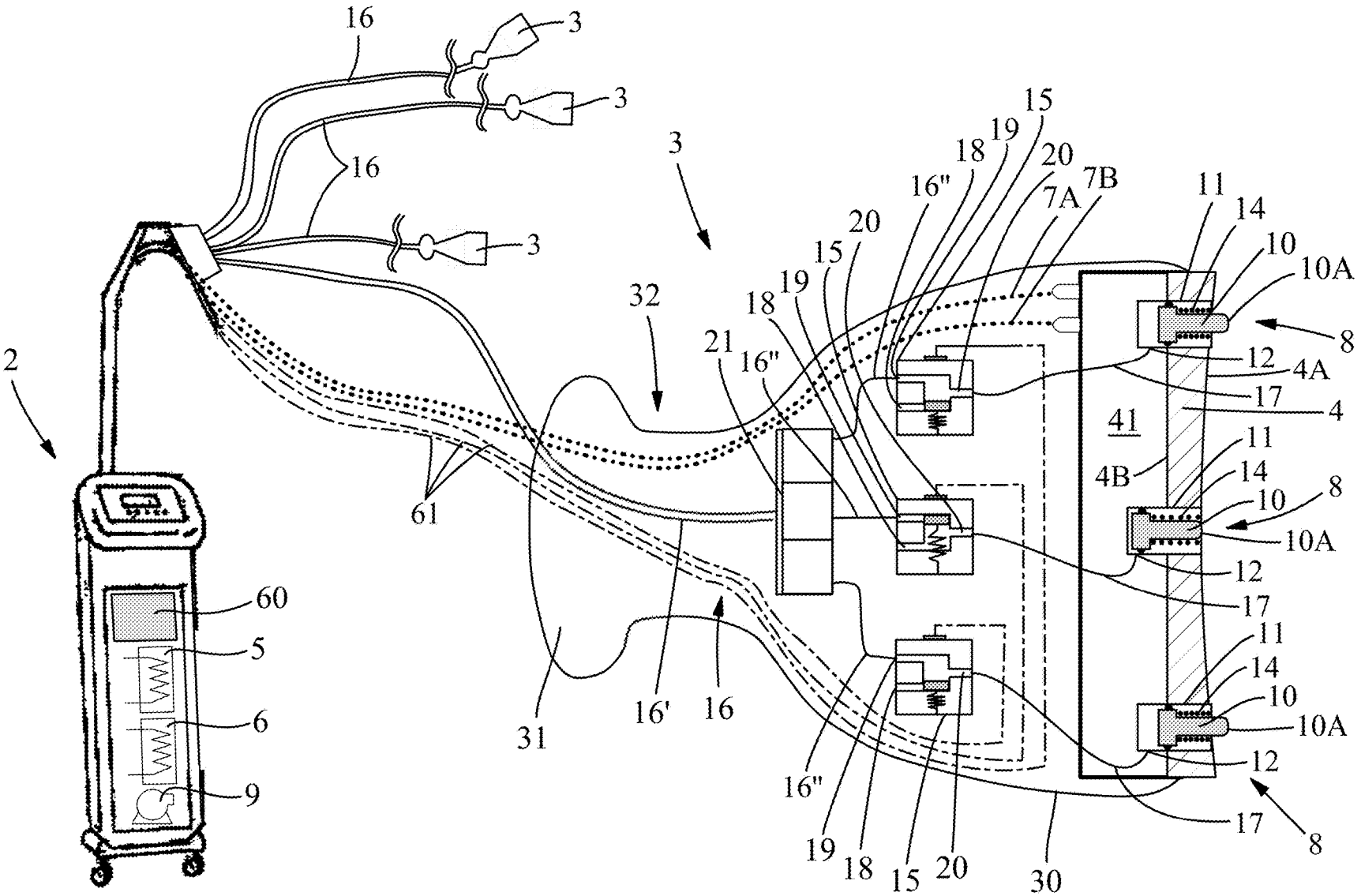
FIG. 2A shows the apparatus of FIG. 1 with a first embodiment of an operational head drawn in an enlarged manner in order to better comprehend the operation thereof, and with some parts removed in order to better illustrate other parts.

Advantageously, in accordance with the embodiment of FIG. 2A, the pneumatic driving means also comprise a distributor 21 to supply the plurality of pneumatic actuators 8. Such distributor 21 is also housed in the operational head 3 and is connected to the compressor 9, by means of a first section 16' of the delivery conduit 16, and to the solenoid valves 15 of the corresponding pneumatic actuators 8 by means of corresponding second sections 16" of the delivery conduit 16.

Figure 2B:
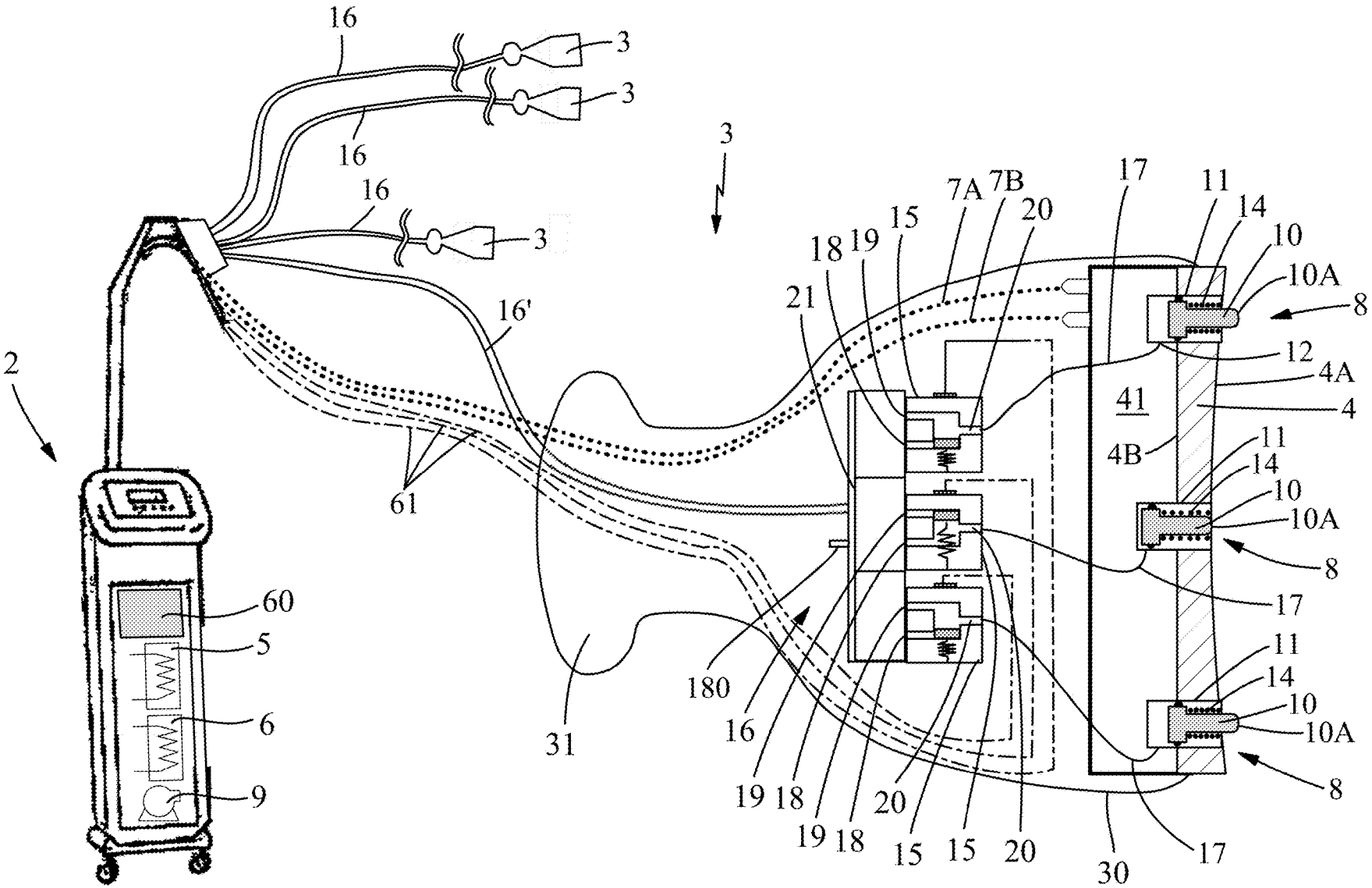
FIG. 2B shows the apparatus of FIG. 1 with a second embodiment of an operational head drawn in an enlarged manner in order to better comprehend the operation thereof, and with some parts removed in order to better illustrate other parts.
Figure 2C:
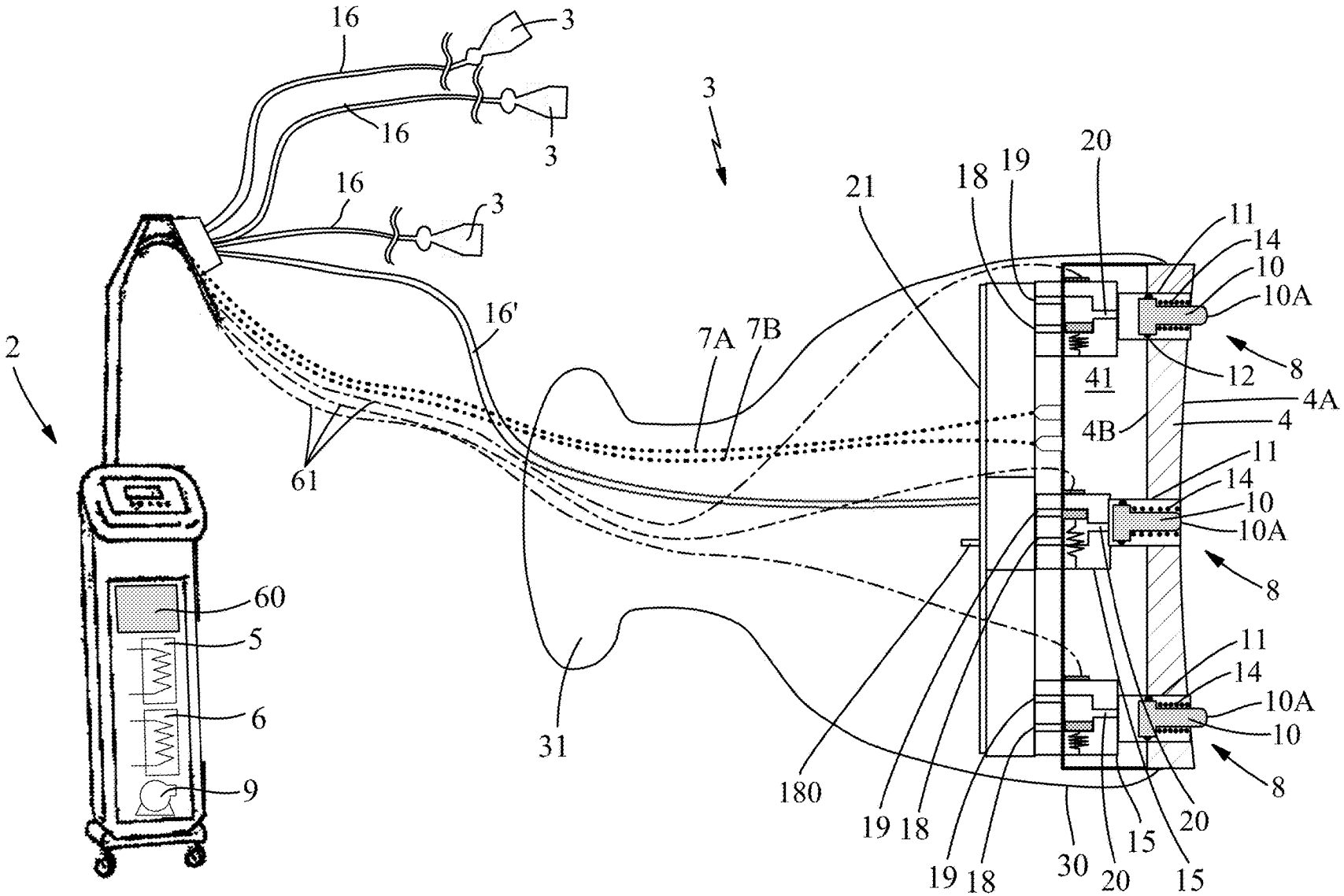
FIG. 2C shows the apparatus of FIG. 1 with a third embodiment of an operational head drawn in an enlarged manner in order to better comprehend the operation thereof, and with some parts removed in order to better illustrate other parts.
Figure 3:
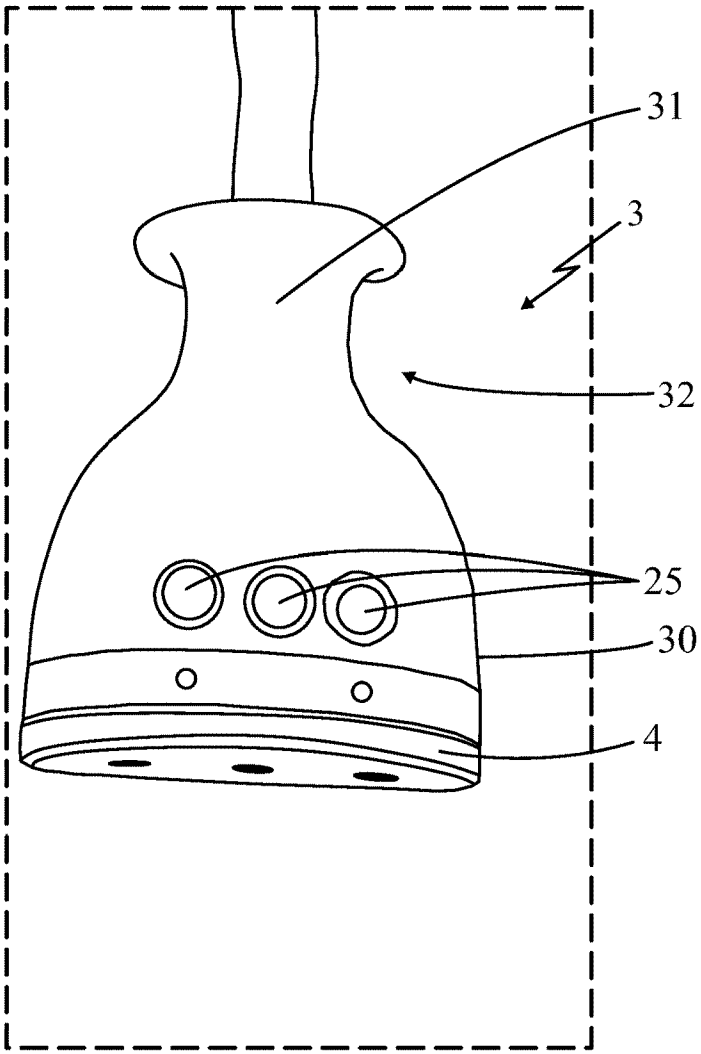
FIG. 3 shows a detail of the apparatus of FIG. 1 relative to an operational head in accordance with a possible embodiment thereof.
Figure 4:
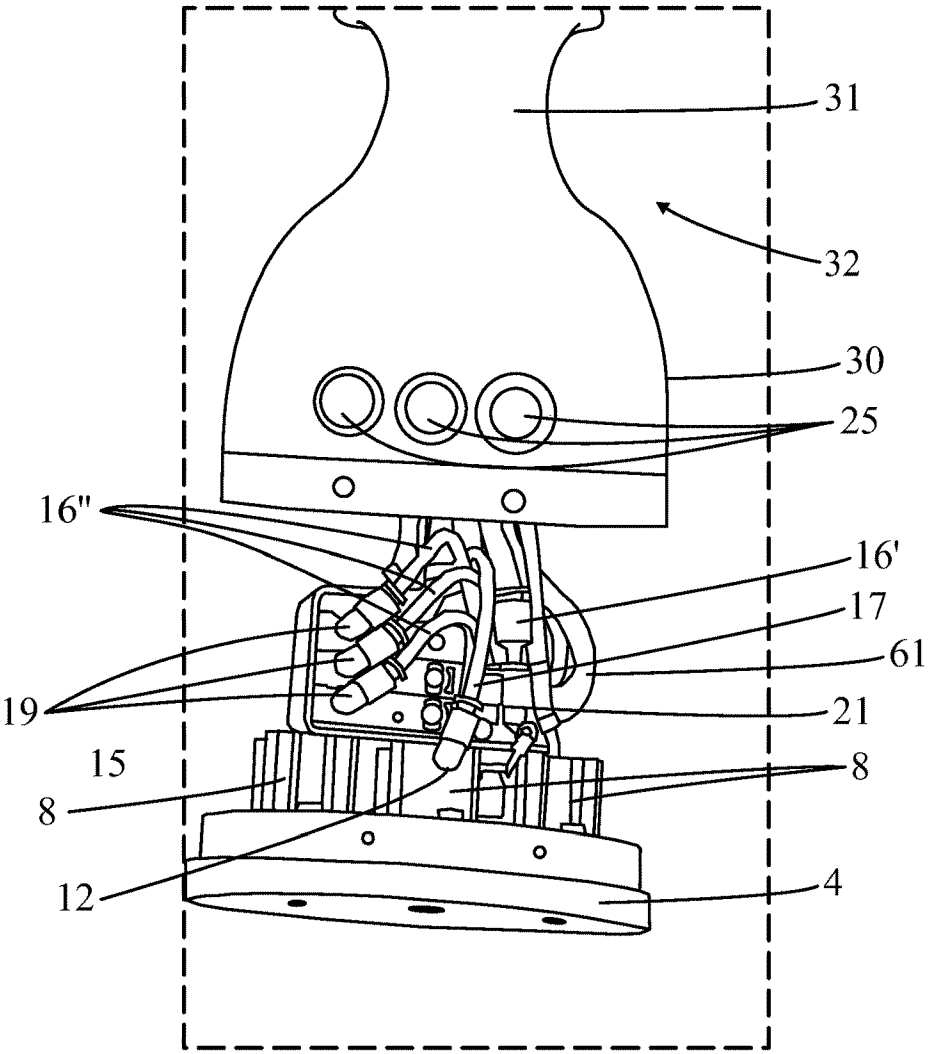
FIG. 4 shows the operational head of FIG. 3 in a first view in partially disassembled condition, in order to appreciate the internal members.
Figure 6:
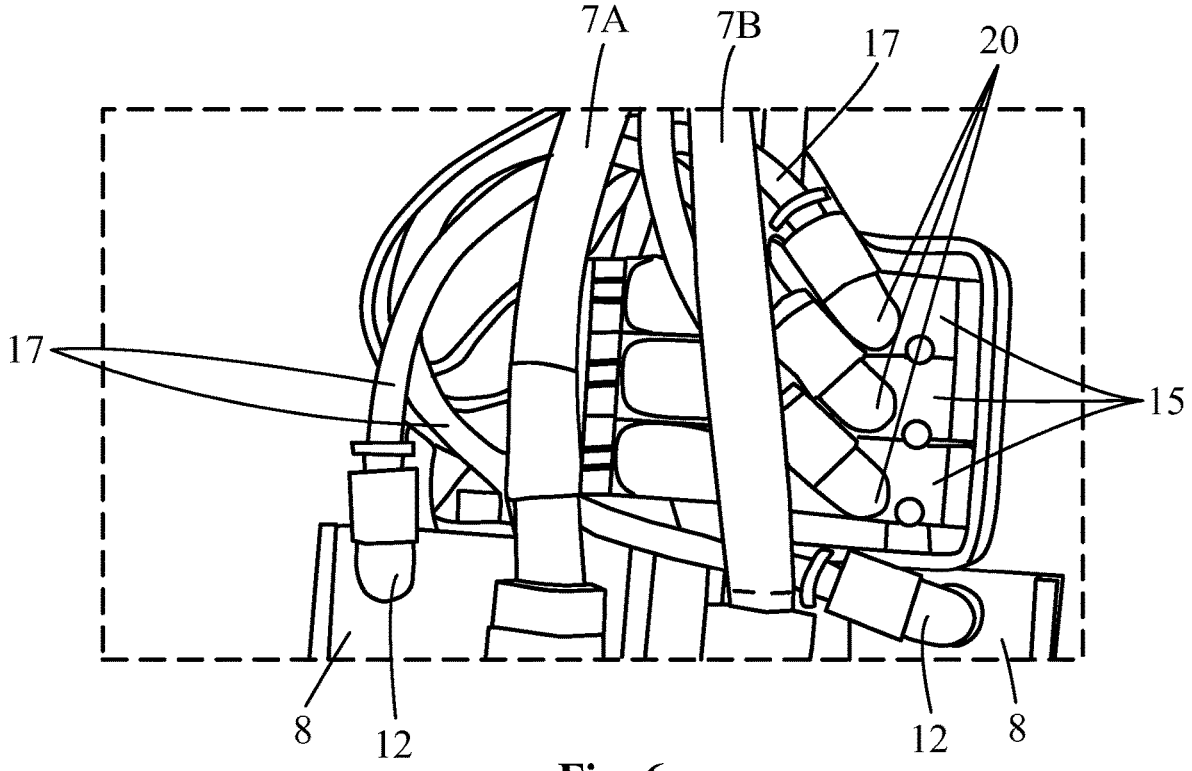
FIG. 6 shows the operational head of FIG. 3 in a second view in partially disassembled condition, in order to appreciate the internal members.
Figure 5:
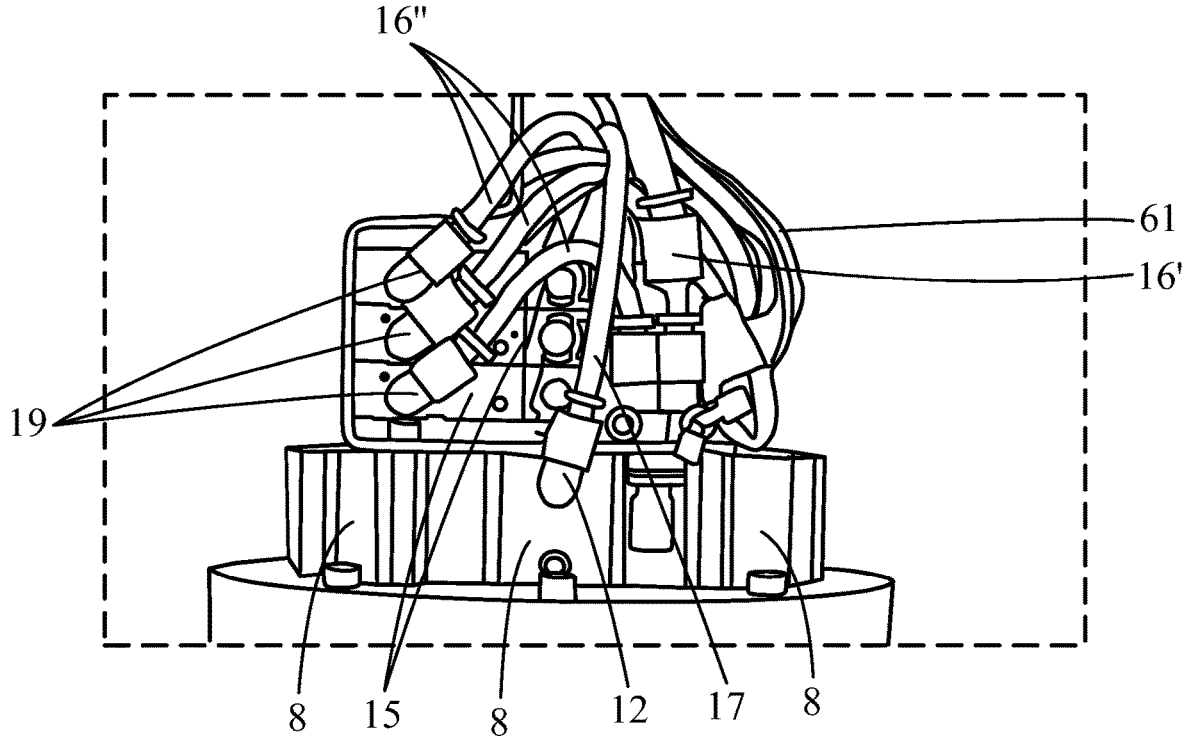
FIG. 5 shows a detailed view of FIG. 4.

Otherwise, in accordance with the embodiments of FIGS. 2B and 2C, the distributor 21 housed in the operational head 3 is directly connected, both mechanically and pneumatically, to each of the solenoid valves 15 of the corresponding pneumatic actuators 8, by means of a corresponding discharge opening 18 and a corresponding second delivery opening 19. In addition, this is thus provided with at least one second discharge opening 180 for discharging the air received by the solenoid valves 15. Otherwise, the discharge openings of the solenoid valves will directly discharge into the environment. In substance, each valve 15 is thus directly mounted on the distributor 21 with the second opening 19 connected to the distributor without the first section 16' of the delivery conduit 16.

Such circumstance allows further reducing the size of the operational head 3.

In accordance with the embodiment of FIG. 2B, each solenoid valve 15 is connected to the pneumatic actuator 8 by means of a connecting conduit 17 which, since it has to connect two components to the interior of the operational head 3, has very limited length and thus can be easily filled with and emptied of compressed air for the operation of the pneumatic actuator 8.

In accordance with the embodiment of FIG. 2C, each solenoid valve 15 is connected both mechanically and pneumatically to the corresponding pneumatic actuator 8, directly by means of the second connector opening 20.

Each valve 15 is thus advantageously a three-way valve with the discharge opening 18 and with a first and a second opening 19 and 20 respectively connected to the delivery conduit 16 and to the connecting conduit 17.

Such circumstance allows further limiting the size of the operational head 3, as well as minimizing the compressed air requirement and the times for the passage of the piston 10 between the two positions.

In accordance with an advantageous characteristic of the present invention, the operational head 3, preferably regardless of the presence of the solenoid valves 15 at its interior or in the central unit 2, is cup-shaped with a hemispherical cap-like portion 30, which is closed in its widest part by the plate 4 and a neck portion 31, which is connected by means of a ring-shaped concavity 32 to the hemispherical portion 30 and preferably has a circular section in the plane transverse to the axis of the neck.

The operational head is, due to such specially-designed anatomic form, susceptible of being easily gripped by an operator, with the area of his hand between the thumb and the index finger around the neck 31 of the operational head 3.

In addition, in the hemispherical cap portion, it is possible to house the solenoid valves 15 and possibly also the distributor 21.

Preferably, the treatment face 4A of the plate 4 is concave for an improved adhesion on the skin of the patient and an improved massage as well as heating/cooling effect.

On the external surface of the operational head 3, buttons 25 are provided (for example, three of these in accordance with the embodiment of three enclosed figures, for the driving of the pneumatic actuators 8 into on and off position, in particular at different frequency (or also at different force), in accordance with the button pressed.

The finding thus conceived therefore attains the pre-established objects.

Of course, in the practical achievement thereof, it can also assume shapes and configurations that are different from those illustrated above, without departing from the present protective scope.

In addition, all details can be substituted by technically equivalent elements and the sizes, shapes and materials used can be of any type in accordance with requirements.

The invention claimed is:

1. An apparatus for carrying out treatments on a human body, the apparatus comprising:

a central unit;

pneumatic driving means comprising at least one compressor housed in said central unit;

at least two operational heads, each operational head provided with:

a plate having at least one treatment surface intended to contact the skin of the patient to be treated;

a plurality of pneumatic actuators connected to said at least one compressor and each pneumatic actuator comprising:

a piston, which is slidably inserted into a hole obtained in said plate and facing said treatment surface, provided with a free end intended to contact the skin of the patient;

a return spring acting on said piston, said piston being operable by said pneumatic driving means to move between a retracted position, in which said free end is contained within said hole, and a protruding position in which said free end extends protruding from said at least one treatment surface, said piston having overcome an action of said return spring;

heating means for production of a hot fluid housed in said central unit, cooling means for production of a cold fluid housed in said central unit; wherein said each operational head is provided with at least one exchanger for thermal exchange with one corresponding fluid of said hot and cold fluids;

wherein said pneumatic driving means comprise:

a plurality of solenoid valves, each solenoid valve associated with a corresponding pneumatic actuator and housed in said each operational head, and connected to said at least one compressor through a delivery conduit and to said corresponding pneumatic actuator to check an air supply of said corresponding pneumatic actuator, and provided with discharge opening for air discharge, through which said solenoid valve is susceptible of discharging pressurized air contained in said corresponding pneumatic actuator to bring back the piston to said retracted position;

a distributor to supply the plurality of pneumatic actuators, which is housed in said each operational head and is connected to said at least one compressor through a first section of said delivery conduit and to the solenoid valves of said corresponding pneumatic actuators.

2. The apparatus of claim 1, further comprising a logic control unit, which is adapted to drive each said solenoid valve between an active position, in which each said solenoid valve closes said discharge opening and each said solenoid valve opens the connection between said at least one compressor and said corresponding pneumatic actuator through said delivery conduit and a connecting conduit; and a passive position, in which each said solenoid valve closes the air supply to said connecting conduit and connects the said connecting conduit to said discharge opening.

3. The apparatus of claim 2, wherein said logic control unit is susceptible of programming to control back and forth movements of the pistons of said pneumatic actuators, in frequency and speed.

4. The apparatus of claim 1, wherein each said solenoid valve associated with said corresponding pneumatic actuator is connected to said corresponding pneumatic actuator through a connecting conduit, wherein said distributor is connected to the solenoid valves of said corresponding pneumatic actuators through corresponding second sections of said delivery conduit.

5. The apparatus of claim 1, wherein said distributor is directly connected to each of said solenoid valves of said corresponding pneumatic actuator through a corresponding discharge opening and a corresponding second delivery opening; said distributor being provided with at least one second discharge opening to discharge air received from said solenoid valves; each said solenoid valve being connected to said corresponding pneumatic actuator through a connecting conduit.

6. The apparatus of claim 1, wherein said distributor is directly connected to each of said solenoid valves of said corresponding pneumatic actuator through a corresponding discharge opening and a corresponding second delivery opening; said distributor being provided with at least one second discharge opening to discharge air received from said solenoid valves; each said solenoid valve being connected to said corresponding pneumatic actuator directly through a second connecting opening.

7. The apparatus of claim 1, wherein said each operational head is cup-shaped with a hemispherical cap portion closed by said plate and a neck portion connected with a ring-shaped concavity to said hemispherical portion; said each operational head being susceptible of being gripped by an operator with an area between the operator's thumb and the operator's index finger around the neck portion of said each operational head.

8. The apparatus of claim 1, wherein the at least one treatment surface of said plate is concave.

9. The apparatus of claim 1, wherein buttons are associated to each said operational head for driving of said pneumatic actuators.

* * * * *